US010053892B2

(12) United States Patent
Merget et al.

(10) Patent No.: US 10,053,892 B2
(45) Date of Patent: Aug. 21, 2018

(54) ELECTRIC MOTOR VEHICLE LOCK WITH EMERGENCY UNLOCKING

(71) Applicant: Kiekert Aktiengesellschaft, Heiligenhaus (DE)

(72) Inventors: Michael Merget, Mettmann (DE); Thorsten Bendel, Oberhausen (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 103 days.

(21) Appl. No.: 14/914,680

(22) PCT Filed: Jul. 14, 2014

(86) PCT No.: PCT/DE2014/100252
§ 371 (c)(1),
(2) Date: Apr. 19, 2016

(87) PCT Pub. No.: WO2015/027984
PCT Pub. Date: Mar. 5, 2015

(65) Prior Publication Data

US 2016/0215530 A1 Jul. 28, 2016

(30) Foreign Application Priority Data

Aug. 30, 2013 (DE) ..... 10 2013 217 377

(51) Int. Cl.
*E05B 79/10* (2014.01)
*E05B 85/24* (2014.01)
(Continued)

(52) U.S. Cl.
CPC ..... *E05B 79/10* (2013.01); *E05B 77/02* (2013.01); *E05B 77/12* (2013.01); *E05B 81/14* (2013.01);
(Continued)

(58) Field of Classification Search
CPC ..... E05B 79/10; E05B 85/26; E05B 85/243; E05B 81/14; E05B 77/12; E05B 77/02; E05B 81/90
See application file for complete search history.

(56) References Cited

U.S. PATENT DOCUMENTS

| | | | | |
|---|---|---|---|---|
| 6,471,259 | B1 | 10/2002 | Weyerstall | |
| 2010/0052336 | A1 | 3/2010 | Bendel et al. | |
| 2014/0175813 | A1* | 6/2014 | Margheritti | E05B 77/34 292/201 |

FOREIGN PATENT DOCUMENTS

| | | |
|---|---|---|
| CN | 2314984 | 4/1999 |
| CN | 101542083 A | 9/2009 |

(Continued)

OTHER PUBLICATIONS

Machine translation of CN2314984 by Patent Translate Powered by EPO and Google on Apr. 27, 2017.

(Continued)

*Primary Examiner* — Kristina R Fulton
*Assistant Examiner* — Thomas L Neubauer
(74) *Attorney, Agent, or Firm* — Woodard, Emhardt, Moriarty, McNett & Henry LLP

(57) ABSTRACT

The object of the invention is to be able, with little expenditure of electrical energy and within a short time, to change over a lock, which can be opened electrically, such that said lock can also be opened mechanically. To achieve this, a locking device with a lock, in particular for a motor vehicle, is provided with a locking mechanism, the rotary latch of which can be latched to at least one pawl in a main latching position and in a preliminary latching position. The locking device has an electric drive with which the lock can be opened electrically in normal operation. It furthermore has an actuating device with which the lock can be changed over from normal operation to emergency operation in the event (Continued)

of an emergency. During this changeover, the lock is adjusted from the main latching position into the preliminary latching position, and the lock can be opened mechanically in said preliminary latching position.

20 Claims, 2 Drawing Sheets

(51) Int. Cl.

| | |
|---|---|
| ***E05B 85/26*** | (2014.01) |
| ***E05B 77/02*** | (2014.01) |
| ***E05B 77/12*** | (2014.01) |
| ***E05B 81/14*** | (2014.01) |
| *E05B 81/90* | (2014.01) |

(52) U.S. Cl.
CPC ..... *E05B 85/243* (2013.01); *E05B 85/26* (2013.01); *E05B 81/90* (2013.01)

(56) References Cited

FOREIGN PATENT DOCUMENTS

| | | | |
|---|---|---|---|
| DE | 19547724 | A1 | 6/1997 |
| DE | 10048709 | A1 | 4/2002 |
| DE | 102007003948 | A1 | 5/2008 |
| DE | 102012003743 | A1 | 8/2013 |
| DE | 102013207725 | A1 | 11/2014 |
| WO | WO 0231298 | A1 | 4/2002 |
| WO | WO 2004079137 | A2 | 9/2004 |
| WO | WO 2006053553 | A2 | 5/2006 |

OTHER PUBLICATIONS

Machine translation of WO0231298A1 by Lexis Nexis Total Patent on Apr. 28, 2017.
Machine Translation of DE10048709A1 by Lexis Nexis Total Patent on Apr. 6, 2016.
Machine Translation of DE102012003743A1 by Lexis Nexis Total Patent on Apr. 6, 2016.
Machine Translation of DE102013207725A1 by Lexis Nexis Total Patent on Apr. 6, 2016.
Machine Translation of DE19547724A1 by Lexis Nexis Total Patent on Apr. 6, 2016.
Machine Translation of WO2004079137A2 by Lexis Nexis Total Patent on Apr. 6, 2016.
Machine Translation of WO20060553A2 by Lexis Nexis Total Patent on Apr. 6, 2016.

* cited by examiner

ELECTRIC MOTOR VEHICLE LOCK WITH EMERGENCY UNLOCKING

BACKGROUND

The invention relates to a closure device with a latch in particular for a motor vehicle with a locking mechanism comprising a catch and at least a pawl for latching of the catch.

The purpose of a latch of such a closure device is for the temporary closure of openings in motor vehicles or buildings with the aid of doors or flaps. In the closed state of such a latch, the catch reaches around an in particular bracket-shaped locking bolt which is generally attached to the chassis in the case of a motor vehicle. If the catch reaches a closed position by means of pivoting effected with the aid of the locking bolt starting in an open position, the catch is ultimately latched into place by means of the pawl. A locking area of the pawl is then adjacent to a locking area of the catch, whereby the catch is prevented from being rotated back in the direction of the open position. The locking bolt can no longer leave the locking mechanism in the closed position.

For opening it is necessary to move the pawl out of its latching position. If the pawl has been moved out of its latching position, the catch rotates in the direction of the open position. In the open position of the catch and thus in the open position of the locking mechanism, the locking bolt can leave the lock. The door of flap can thus be opened again.

There are latches with two different latching positions of the catch. The catch can then initially be latched into the pre-ratcheting position and finally into the so-called main ratcheting position by a further rotation in the closure direction. In the pre-ratcheting position a locking bolt can no longer leave the locking mechanism. However, a relevant door or flap is not yet completely closed. Such a door or flap is only completely closed when the catch is rotated to the main ratcheting position and latched into place here. A second pawl can be provided for latching into place in the pre-ratcheting position. However, it is also possible to latch the catch with only one pawl both in the pre-ratcheting position and in the main ratcheting position.

The latch can comprise a blocking lever which is capable of blocking a pawl if the pawl latches the catch into place. In order to open such a locking mechanism, the blocking lever must first be moved out of its blocking position.

In order to open a latch with especially little force, in the latched state the catch is able to initiate an opening torque into the pawl. The opening torque can cause the pawl to be moved out of its latching position. Such a latch prevents undesirable movement by a blocking lever. If the blocking lever is moved out of its blocking position, the latch then opens automatically. Such a state of the art is known from the publication DE 10 2007 003 948 A1.

There is an activation device to open a latch. The locking mechanism opens when the activation device is activated. A door handle or a flap can be part of the activation device. This handle is generally connected to an activation lever of the latch via a rod or a Bowden cable. If the handle is activated, the activation lever of the latch is pivoted by means of the rod or Bowden cable in such a way that the latch opens. A motor vehicle can demonstrate a generally pivotable external handle which can be accessed from outside, and/or a generally pivotable internal handle which can be accessed from inside.

As known from WO 2006/053553 A2, a latch or a closure device with such a latch can demonstrate an anti-theft device. Mechanical opening is not possible when the anti-theft device is activated. Neither is electrical opening possible with the aid of an opening device. An anti-theft device must be previously deactivated again in order to be able to open a door or flap.

In accordance with the publication DE 100 48 709 A1 in normal operation the known latch cannot be opened by activation of an external handle, because in normal operation a necessary connection between an activation lever and the locking mechanism is absent. The latch can only be opened from the outside in normal operation with the aid of an electrical drive. However, in an emergency the electrical drive makes the mechanical connection between the handle and the locking mechanism in order then to be able to open the latch mechanically in the event of an emergency by activation of the external handle. An emergency is present, for example, in the event of an accident or a power outage. If a sensor indicates the presence of an emergency, the electrical drive produces the mechanical connection within 10 ms in order to be able to open the latch without power.

An airbag sensor can act as a sensor. If an airbag sensor indicates an accident, several milliseconds (ms) of electrical energy are generally available following the signal in order that the mechanical connection can be made by the electrical drive. The electrical energy supply can then fail.

A further sensor can monitor the charging state of a motor vehicle battery. If the charging state of the battery falls below a certain threshold value, this breakdown or emergency can be indicated by the sensor in order to automatically ensure that the electrical drive makes the mechanical connection in order to subsequently enable mechanical opening.

SUMMARY

Insofar as not stated otherwise hereinafter, the closure device in accordance with the invention described below can demonstrate the aforementioned characteristics individually or in any combination.

It is the task of the invention to further develop a closure device with an electrical opening mechanism. In particular, the present invention strives towards being able to shift a latch of such a closure device in particular in a short timeframe from normal operation to emergency operation with low consumption of electrical energy.

In order to solve the task, a latch comprises the characteristics of the first claim. Advantageous designs arise from the sub claims.

A closure device with a latch, in particular for a motor vehicle with a locking mechanism is provided for the solution, the catch of which can be latched in a main ratcheting position and pre-ratcheting position with at least a pawl. The closure device possesses an electrical drive, with which the latch can be electrically opened in normal operation. Furthermore, it possesses an actuator with which the latch can be shifted from normal operation to emergency operation in the occurrence of an emergency. In this shifting, the latch is moved from the main ratcheting position into the pre-ratcheting position. The latch can be mechanically opened in the pre-ratcheting position. Mechanical opening of a door or flap is at least not possible in principle externally if the locking mechanism is latched in the main ratcheting position.

The presence of a pre-ratcheting position on a motor vehicle latch improves the security and is therefore widespread. If a latch is moved from the main ratcheting position into the pre-ratcheting position, a gap occurs or increases between the pertaining door or flap and the adjacent chassis of the motor vehicle. This gap can now enable a mechanical activation device to be preferably accessible at least from the outside in order to open the motor vehicle door or flap. But a mechanism can also be present which always enables the door or flap to be mechanically opened and/or only if the latch is latched in the pre-ratcheting position.

In an advantageous design, a mechanical activation device of the closure device can be accessed when the latch is latched in the pre-ratcheting position. The mechanical activation device cannot be accessed if the latch is latched into the main ratcheting position. This execution form reliably ensures that a pertaining door or flap cannot be opened in an unauthorized manner in normal operation. The door or flap can be mechanically opened following an emergency.

In one design of the invention, an activation element such as a lever or a loop is moved into the gap arising due to shifting to emergency operation with the aid of the electrical drive in such a way that the activation element can be accessed from the outside. Due to subsequent activation of the activation element the door or flap can then be opened mechanically.

In one design of the invention, the locking mechanism is created in such a way that in the main ratcheting position the catch initiates an opening torque into the pawl which latches the catch in the main ratcheting position. There is a blocking lever which blocks this pawl in the main ratcheting position. The blocking lever is moved out of its blocking position for a shift from normal operation to emergency operation, in particular with the aid of the electrical drive with which the latch can be electrically opened. Alternatively, another drive can be provided for which must generally be prevented however in order to minimize the number of drives used. Due to the opening torque initiated into the pawl, the pawl then moves out of its pre-ratcheting position and the catch can move into the pre-ratcheting position. In the pre-ratcheting position the catch can then be latched with this pawl or a different pawl. A blocking lever can be moved out of its blocking position with especially low energy consumption. Consequently, this execution form enables a latch to be shifted from normal operation to emergency operation with especially low energy consumption. As the blocking lever has a direct impact on the locking mechanism, it also shifts from normal operation to emergency operation with particular speed.

In one design of the invention there is an anti-theft device which does not permit bolting of the latch when it is located in the pre-ratcheting position. In this execution form in particular there is a sensor such as a microswitch with which it can be ascertained if the latch is located in its pre-ratcheting position in order to automatically prevent the anti-theft device being activated if the latch is located in the pre-ratcheting position.

In one design of the invention there is a control device which prevents the latch from latching in the pre-ratcheting position during electrical opening when the latch is opened electrically. The control device is preferably an electrical control device which can only prevent engaging into the pre-ratcheting position if a power supply is available.

In one design of the invention the control device can comprise a control lever which can control the latching of a pawl in the pre-ratcheting position. An example of a control lever is described in the German patent registration 102013207725. Such a control lever is preferably located in a start position, the consequence of which is that the latch latches in the pre-ratcheting position. For opening which moves the control lever in particular by the stated electrical drive out of the start position. The control lever then records the pawl provided for the pre-ratcheting position in such a way that it prevents this pawl engaging in the pre-ratcheting position in order to latch the catch. This execution form is of particular advantage in particular combined with the execution form in which the latch otherwise can be opened by moving the blocking lever out of its blocking position. For the shift to emergency operation it can be sufficient for only the blocking lever to be moved out of its blocking position which can occur with particular speed and with especially low energy consumption. The combination of these characteristics therefore solves the stated tasks particularly well.

In one design the latch comprises a control contour which is capable of controlling latching in the pre-ratcheting position. If the control contour is located in a start position then the control contour controls the movement of a pawl provided for in such a way that that it latches the catch in the pre-ratcheting position if the catch moves in the direction of the opening position, starting from the main ratcheting position. If the latch is opened electrically, the control contour is moved in such a way that the catch is not latched in the pre-ratcheting position by the pawl provided for. This execution form is of particular advantage in particular combined with the execution form in which the latch otherwise can be opened by moving the blocking lever out of its blocking position. For the shift to emergency operation it can then be sufficient for only the blocking lever to be moved out of its blocking position which can occur with particular speed and with especially low energy consumption. The combination of these characteristics therefore solves the stated tasks particularly well.

In one design of the invention an external door handle is dispensed with as it is no longer necessary in normal operation and is ensured in an emergency in the event of a power outage which can nevertheless be opened mechanically. This does not lead to manufacturing advantages, but furthermore enables formations which are not possible for a customary motor vehicle with an external door handle. This also contributes to security from theft. An external door handle for the purpose of the present invention can always be accessed from the outside and is pivotable, whereby the door can be mechanically opened by pivoting the external door handle.

In one execution form the latch comprises an emergency lever which is set up in such a way and/or the movement of which is controlled in such a way that it is only capable of latching in the pre-ratcheting position in an emergency.

DETAILED DESCRIPTION OF THE DRAWING

Figure 1:
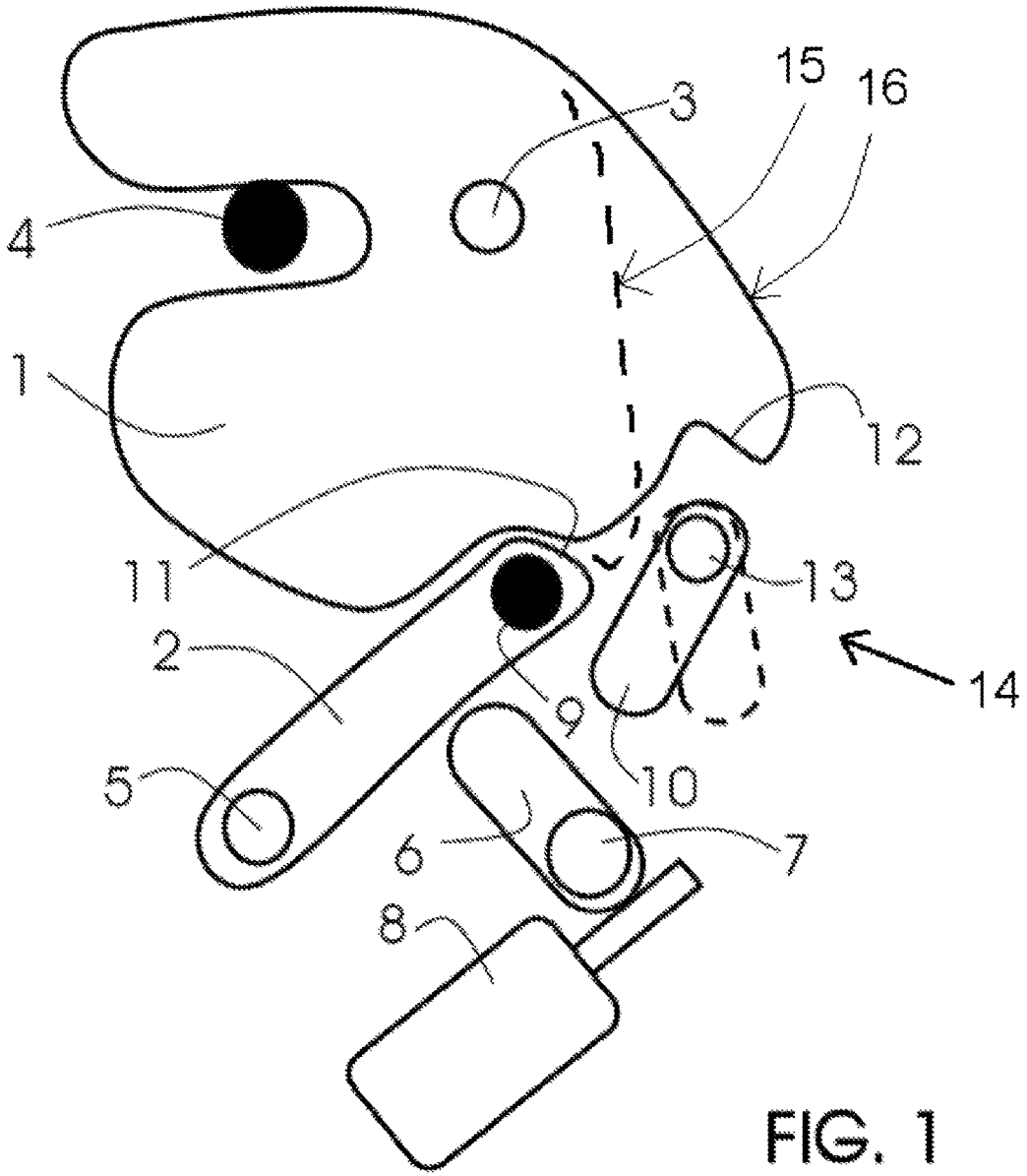
FIG. 1 illustrates a latch locking mechanism with a catch, a pawl and a blocking lever.

FIG. 1 sketches a locking mechanism of a latch with a catch 1, which is latched by a pawl 2 in the main ratcheting position shown. If the catch 1 is rotated clockwise around its axis 3, the catch 1 moves in the direction of the opening position. If the catch 1 has reached its opening position by rotation in a clockwise direction, the locking bolt 4 held by it can then leave the locking mechanism. The pawl 2 is adjacent to the catch 1 in such a way that the catch 1 initiates an opening torque into the pawl 2. The opening torque rotates the pawl 2 in a clockwise direction around its axis 5 out of its shown latching position. In the main ratcheting position shown this is prevented by a blocking lever 6, which for example can be moved around its axis 7 in an anticlockwise direction by means of the electrical drive 8 out of its blocking position shown.

If the blocking lever 6 is moved out of its blocking position by the electrical drive 8, the pawl 2 leaves its latching position shown in FIG. 1 due to the opening torque initiated. The pivoting movement in the clockwise direction of the pawl 2 ends as soon as a bolt 9 protruding from the pawl 2 contacts the pivotable control lever 10. The control lever 10 in its starting position depicted therefore limits the pivoting movement of the pawl 2 from its latching position. If the lever 10 is in its starting position, main ratcheting position 16, the pawl 2 ultimately latches the catch 1 into the pre-ratcheting position 15 (shown with a dashed line). The locking area 11 of the pawl 2 is then adjacent to the locking area 12 of the catch. Such a latching of the catch 1 in the pre-ratcheting position 15 is prevented if the lever 10 is pivoted by a drive not depicted into its position shown in dotted lines by pivoting in an anticlockwise direction around its axis 13. Lever 10 is part of actuator 14 that enables moving catch 1 from its main ratcheting position 16 into its pre-ratcheting position 15.

In normal operation, pivoting takes place as described to open the locking mechanism and the blocking lever 6 and also the control lever 10 in order to enable opening of the locking mechanism, in an emergency only the blocking lever 6 is moved out of its blocking position. Thus, the locking mechanism is then moved from the main ratcheting position into the pre-ratcheting position.

Figure 2:
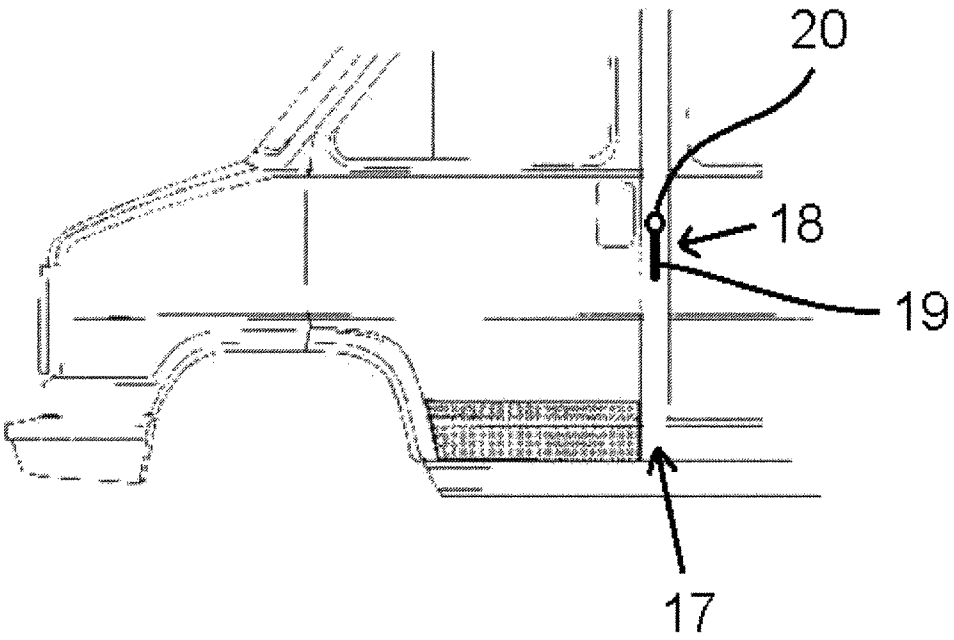
FIG. 2 illustrates a vehicle exterior showing an activation device for the FIG. 1 latch locking mechanism positioned in a gap between a door and an adjacent body panel.

FIG. 2 illustrates a door and an adjacent chassis of a motor vehicle with lever of the activation device 19 and/or loop of the activation device 20 positioned within gap 17 between the door and the adjacent chassis of the motor vehicle. Lever of the activation device 19 and/or loop of the activation device 20 are part of activation device 18 that is accessible from outside the vehicle through gap 17. Gap 17 my arise or increase in size when the latch is moved from main ratcheting position 16 into pre-ratcheting position 15.

REFERENCE SIGN LIST

1: Catch
2: Pawl
3: Catch axis
4: Locking bolt
5: Pawl axis
6: Blocking lever
7: 16: Axis of the blocking lever
8: Electrical drive
9: Bolt on pawl
10: Control lever
11: Locking surface of the pawl
12: Locking surface of the catch
13: Control lever axis
14: actuator
15: pre-ratcheting position
16: main ratcheting position
17: gap
18: activation device
19: lever of the activation device
20: loop of the activation device

The invention claimed is:

1. A closure device with a latch in particular for a motor vehicle with a locking mechanism comprising a catch and at least a pawl operable to latch the catch in a pre-ratcheting position and in a main ratcheting position, wherein the latch, when rotated in a closure direction, is initially latched into the pre-ratcheting position and by a further rotation in the closure direction finally latched into the main ratcheting position, with an electrical drive for electrically opening the latch, and an activation device for mechanically opening the latch in the pre-ratcheting position, an actuator that is configured to shift the latch from normal operation to emergency operation in the occurrence of an emergency, wherein the shifting moves the latch from the main ratcheting position into the pre-ratcheting position.

2. The closure device in accordance with claim 1, wherein the closure device is configured such that the activation device is accessible when the latch is latched in the pre-ratcheting position and the activation device is not accessible when the latch is latched in the main ratcheting position.

3. The closure device in accordance with claim 2, wherein the closure device is configured such that the activation device is accessible due to a gap or in a gap which arises or increases by moving the latch from the main ratcheting position to the pre-ratcheting position.

4. The closure device in accordance with claim 3, wherein an activation element of the activation device is moved into the gap as soon as this arises or increases.

5. The closure device in accordance with claim 4, wherein a lever or a loop of the activation device is moved into the gap as soon as this arises or increases.

6. The closure device in accordance with claim 5, wherein the latch is configured such that the catch in the main ratcheting position initiates an opening torque into the pawl that the latch comprises a blocking lever which blocks the pawl in the main ratcheting position, which latches the catch, whereby the blocking lever is moved by the electrical drive out of its blocking position in order to shift the latch in an emergency from the main ratcheting position to the pre-ratcheting position.

7. The closure device in accordance with claim 6, wherein the closure device comprises an anti-theft device, which cannot be activated when the latch is in the pre-ratcheting position, wherein there is a sensor or a microswitch configured to ascertain if the latch is located in its pre-ratcheting position in order to automatically prevent the anti-theft device being activated if the latch is located in the pre-ratcheting position.

8. The closure device in accordance with claim 1, wherein a control device is configured such that during electrical opening of the latch, the control device prevents the latch from latching in the pre-ratcheting position.

9. The closure device in accordance with claim 8, wherein the control device configured such that the control device is only capable of preventing latching in the pre-ratcheting position when an electrical power supply is available.

10. A door for a motor vehicle with a closure device in accordance with claim 1, wherein the door does not possess a pivotable external handle enabling the latch of the closure device to be opened.

11. The door of claim 10, wherein the door and the closure device are configured such that if the latch is moved from the main ratcheting position into the pre-ratcheting position, a gap occurs or increases between the pertaining door and the adjacent chassis of the motor vehicle, wherein the activation device is accessible due to the gap or in the gap.

12. The closure device in accordance with claim 1, wherein the closure device is configured such that in normal operation, to enable opening of the locking mechanism, the blocking lever is pivoted out of its blocking position.

13. The closure device in accordance with claim 12, further comprising a control lever that is configured to limit in its starting position a pivoting movement of the pawl from its latching position.

14. The closure device in accordance with claim 13, wherein the closure device is configured such that in normal operation, to enable opening of the locking mechanism, the control lever is pivoted out of its starting position.

15. The closure device in accordance with claim 13, wherein the control device comprises the control lever.

16. The closure device in accordance with claim 14, wherein the closure device is configured such that in normal operation, the control lever and the blocking lever are moved to enable opening of the locking mechanism, but in an emergency, only the blocking lever is moved out of its blocking position.

17. The closure device in accordance with claim 16, wherein the control lever has a control contour which is capable of controlling latching in the pre-ratcheting position.

18. The closure device in accordance with claim 17, wherein the closure device is configured such that in an emergency, when the blocking lever is moved out of its blocking position by the electrical drive, the pawl leaves its latching position and the control contour of the control lever located in the start position controls the movement of the pawl in such a way that that the pawl latches the catch in the pre-ratcheting position when the catch moves from the main ratcheting position in the direction of the opening position.

19. The closure device in accordance with claim 18, wherein the closure device is configured such that if the latch is opened electrically, the control contour is moved in such a way that the catch is not latched in the pre-ratcheting position by the pawl.

20. The closure device in accordance with claim 18, wherein the control device comprises the control lever and is configured such that during electrical opening of the latch in normal operation, the control lever is moved out of the start position so that the control device prevents the latch from latching in the pre-ratcheting position by the control contour.

* * * * *